US006026756A

United States Patent [19]

Frazer et al.

[11] Patent Number: 6,026,756

[45] Date of Patent: Feb. 22, 2000

[54] COMPOSITE PATTERN MULTIPLE NEEDLE QUILTING METHOD AND APPARATUS

[75] Inventors: James T. Frazer, Tamarac; M. Burl White, Coral Spings, both of Fla.

[73] Assignee: L&P Property Management Company, South Gate, Calif.

[21] Appl. No.: 09/259,483

[22] Filed: Feb. 26, 1999

[51] Int. Cl.[7] ..... D05B 11/00

[52] U.S. Cl. ..... 112/118; 112/163; 112/475.19

[58] Field of Search ..... 112/117, 118, 112/119, 102.5, 163, 167, 305, 307, 314, 315, 475.08, 475.18, 475.19

[56] References Cited

U.S. PATENT DOCUMENTS 4,408,552 10/1983 Kondo et al. ..... 112/119
5,027,726 7/1991 Brower et al. ..... 112/117
5,228,402 7/1993 Sugimoto .
5,228,403 7/1993 Sugimoto .
5,505,150 4/1996 James et al. ..... 112/117 X
5,544,599 8/1996 Frazer et al. ..... 112/118

*Primary Examiner*—Peter Nerbun
*Attorney, Agent, or Firm*—Wood, Herron & Evans, L.L.P.

[57] ABSTRACT

A method of quilting patterns is provided in which pattern files are generated containing quilting machine control data for use by a controller of a quilting machine to produce different quilted patterns. Product information is generated that identifies pluralities of patterns. In response to the product information, the quilting machine controller sequentially reads the pattern files for each of the patterns of the identified plurality and sequentially quilts the plurality of patterns in the form of sub-patterns on the same panel of multi-layered material to form a combination pattern. A multi-needle quilting apparatus is provided with a controller programmed to carry out the method as part of a quilting system in which pattern and product databases are generated and linked for the production of a variety of individual and combination patterns.

9 Claims, 4 Drawing Sheets

COMPOSITE PATTERN MULTIPLE NEEDLE QUILTING METHOD AND APPARATUS

The present invention relates to the quilting of multiple layer materials, and particularly to the formation of complex quilted patterns with multiple needle arrays onto multilayer fabric webs.

BACKGROUND OF THE INVENTION

Quilting is a special art in the general field of sewing in which patterns are stitched through a plurality of layers of material over a two dimensional area of the material. The multiple layers of material normally include at least three layers, one a woven primary or facing sheet having a decorative finished quality, one a usually woven backing sheet that may or may not be of a finished quality, and one or more internal layers of thick filler material, usually of randomly oriented fibers. The stitched patterns maintain the physical relationship of the layers of material to each other as well as provide ornamental qualities. Quilting is performed on the customary quilts or comforters and on the covers of mattresses, for example. In the stitching of quilts for these two applications, two different approaches are typically used. Both approaches use stitches that employ both a top and a bottom thread.

Single needle quilters of the type illustrated and described in U.S. Pat. Nos. 5,640,916 and 5,685,250, hereby expressly incorporated by reference herein, are customarily used for the stitching of comforters and other preformed rectangular panels. Such single needle quilters typically use a pair of cooperating lock stitch sewing heads, one carrying a needle drive that is typically positioned above the fabric and one carrying a bobbin that is opposite the fabric from the needle, with both heads being mechanically linked to move together in two dimensions, relative to the panel, parallel to the plane of the panel. A common operation of this type of quilting apparatus includes the supporting of the panel of fabric on a longitudinally moveable shuttle with the sewing heads moveable transversely of the panel to provide two dimensional stitching capability of the pattern on the panel. With such single needle quilting machines, varied and complex patterns can be produced.

Multiple needle quilters of the type illustrated in U.S. Pat. Nos. 5,154,130 and 5,554,589, hereby expressly incorporated by reference herein, are customarily used for the stitching of mattress covers, which are commonly formed from multi-layered web fed material. Such multi-needle quilters use an array of cooperating chain stitch sewing elements, one element being a needle that is typically positioned above the material and one element being a looper that is opposite the material from the needle, with the entire arrays of both elements being mechanically linked together to move in unison in two dimensions relative to the material, parallel to the plane of the material in paths that corresponds to identical patterns of a pattern array. The needles and loopers also operate in unison so that the sets of elements simultaneously form identical series of stitches.

A common operation of this type of quilting apparatus is to support the multilayered material from a web and advance the web longitudinally relative to the sewing element array and in coordination with the motion and operation of the sewing elements. The sewing element array may be shiftable transversely of the web to provide two dimensional movement of the array relative to the material to give pattern stitching capability on the web. Alternatively, the array may be also maintained stationary in the transverse direction and rollers that support the web may be caused shift transversely relative to the array to move the web relative to the sewing elements. Some multi-needle quilters of this type have longitudinally bi-directional web feeding capability which, when synchronized with the transverse shifting of the web or the sewing elements, provides for 360° pattern sewing capability.

The multi-needle quilters are preferable for sewing mattress covers and for other applications where high speed production is required. With these multi-needle web-fed quilting machines, however, the variety and complexity of patterns is limited.

SUMMARY OF THE INVENTION

An objective of the present invention is to provide a computer controlled pattern quilting method and apparatus that will provide wide variety of quilted patterns, particularly patterns of a high ornamental quality.

According to the principles of the present invention, a quilting machine is provided with a controller programmed to control the operation of the material motion elements and quilting elements of the machine to quilt patterns in response to data in stored pattern files. Certain of these pattern files function as sub-pattern files which are sequentially quilted onto panels of multi-layered material to form combination patterns. Product data identifies the sub-patterns that are required to form a combination pattern specified for a product.

Preferably, the quilting machine is a multi-needle machine by which arrays of each pattern are simultaneously quilted, usually on a panel length section of a web of multi-layered material. In the preferred embodiment of the invention, the pattern files are stored in a memory associated with a programmed controller of a machine. A product database is maintained that contains information effective to associate a particular single or combination pattern with each particular quilt product that the machine is assigned to make. Preferably, a separate pattern information database is maintained with the details needed for the quilting of a pattern, including stitch size and sewing speed information, jump distances between pattern elements, if any, and the coordinates of the starting positions of the patterns. Pluralities of patterns are linked to the records of the product database to identify each of the sub-pattern components that make up combination patterns, when they are called for.

According to the preferred embodiment of the invention, the pattern information records include pattern sequence information that specifies the sequence in which the sub-patterns are to be quilted. The sequence is selected in a way that takes into account material shrinkage or gathering due to the application of the individual sub-patterns of a combination and coordinates the registration of the pattern components. The product record contains information that is generic to the quilting process, such as the initial margin or jump distance through which web material is to be advanced before the first pattern of a sequence is applied. Information particular to the pattern component, such as offset distances of one pattern component relative to another are preferably contained in the pattern database. The data in the individual pattern files is independent of the combination in which the patterns may be used. Pattern files and the sub-pattern records in the pattern information database may used in more than one pattern or combination pattern.

The method and apparatus of the invention increases the variety of patterns that can be produced and makes efficient use of the controller and memory. Classes of patterns that are not available with single pattern systems can be produced.

These and other objects of the present invention will be more readily apparent from the following detailed description of the drawings in which:

DETAILED DESCRIPTION OF THE PREFERRED EMBODIMENT

Figure 1:
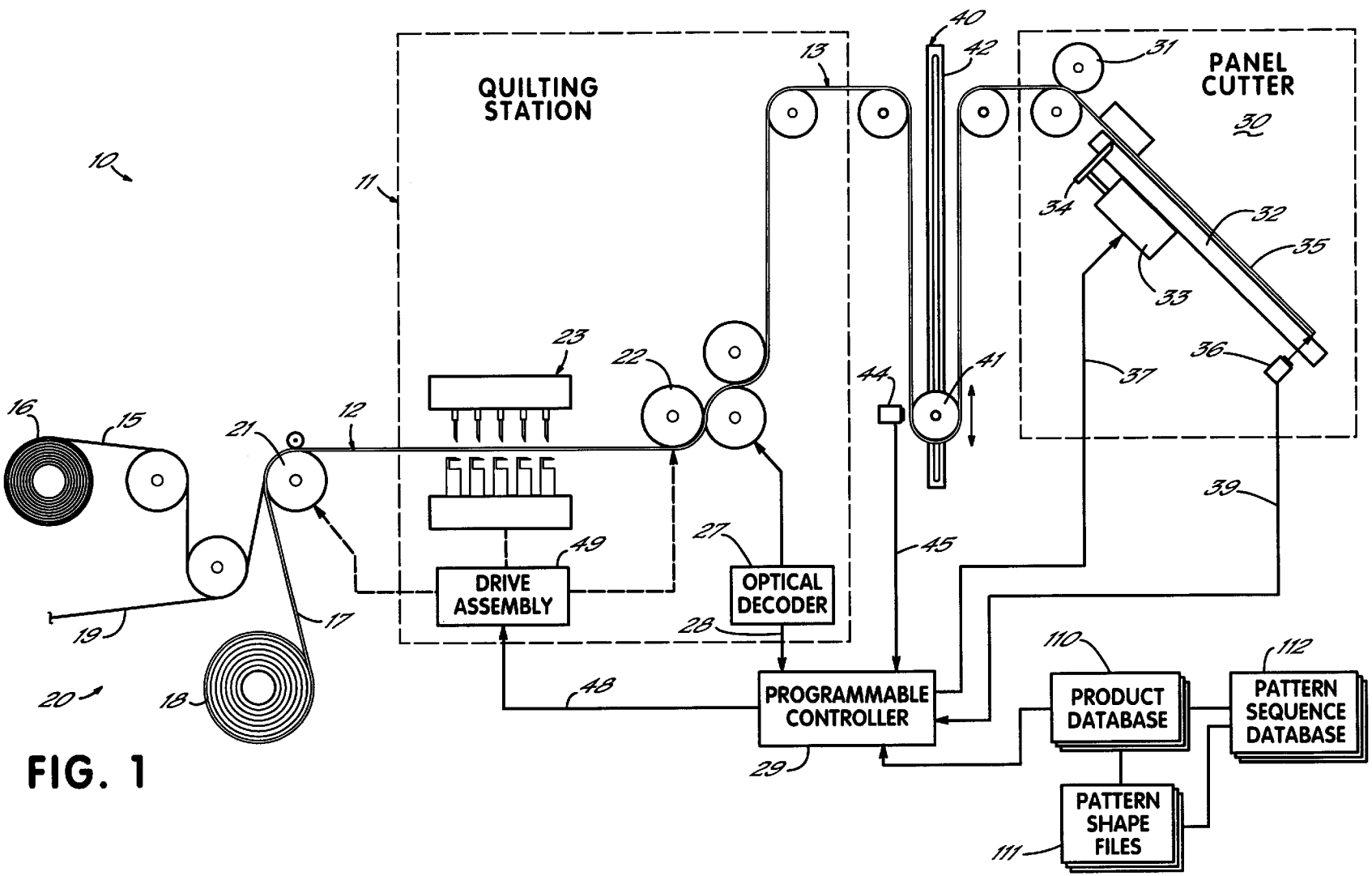
FIG. 1 is a diagrammatic illustration of a quilting machine embodying principles of the present invention.

A commercial quilting machine 10 that forms part of the preferred embodiment of the invention is diagrammatically illustrated in FIG. 1, and is described in more detail in U.S. Pat. No. 5,554,589 entitled Program Controlled Quilter and Panel Cutter System with Automatic Shrinkage Compensation, expressly incorporated herein by reference. The machine 10 includes a quilting station 11 at which stitched patterns are applied to a multiple layered web of fabric 12 to form a quilted web 13. The multiple layered web of fabric 12 is formed by combining a web of top goods 15 from a top goods supply roll 16, a web of backing 17 from a backing material supply roll 18, and a web of filler 19 interposed between the backing and top goods webs at the upstream end 20 of the quilting station 11.

The quilting station 11 has front and back sets of transversely extending, transversely shiftable, reversible rollers 21 and 22, respectively, which engage and move the web 12 relative to a stitching mechanism 23 at the quilting station. Of the rollers 21 and 22, the rollers 22 are the primary feed rollers of the quilting station that maintain tension on the web 12 between the rollers 21 and 22. The feed rollers manipulate the web 12 longitudinally relative to the stitching mechanism 23 to define the stitched pattern being applied to the web 12, and control the overall advance or downstream feed of the quilted web 13.

Attached to the shaft of one of the feed rollers 22 is a digital optical encoder 27, or other type of measuring instrument, for measuring the linear feed of the web 13 through the nip of the rollers 22. The encoder 27 has an output 28 input of a programmable controller 29, which is preferably a microprocessor based digitally programmable industrial controller. In the course of quilting, the web may be longitudinally reversed several times through the quilting station 11 in order to sew 360° or other complex patterns, so the encoder is direction sensitive.

Downstream of the quilter 11, the machine 10 includes a panel cutter 30 having a set of web feed elements 31 at its upstream end which engage the quilted web 13 being fed from the quilting station 11 and advance it onto a downwardly inclined table 32. The feed elements 31 are preferably opposed feed rollers which engage the quilted web 13 and maintain upstream tension on the quilted web 13. The panel cutter 30 includes a cutoff mechanism 33, which includes a transverse blade or knife 34 which cuts the quilted web 13 in response to a cutoff signal from the controller 29 along line 37, to transversely sever a finished quilted panel 35. At the lower end of the table 32 is a photo-detector or other sensor 36 operable to detect the presence of quilted fabric and send a signal along input line 39 to the controller 29.

Between the quilting station 11 and the panel cutter 30 is an accumulator section 40 which accumulates quilted web 13 fed from the feed rollers 22 and supplies quilted web 13 to the feed elements 31 of the panel cutter 30, and to resupply web 13 to the feed rollers 22 when the feed of the web 13 is reversed. The accumulator section 40 includes a transverse accumulator roll 41 that rides in vertical track 42 and is generally is supported by the web 13 such that the weight of the roll 31 maintains a generally uniform tension on the web 13. A limit switch or other roll detector 44 at the bottom of track 42 generates a signal along an input line 45 to the controller 29 to signal that the accumulator 40 is at its maximum capacity. A similar switch (not shown) may be provided at the top of the track 42 to signal that the accumulator is at its minimum capacity.

The controller 29 is programmed to respond to the signals at its inputs and to control the feed and cutoff in such a way as to synchronize the quilting, feeding and cutting so as to compensate for the shrinkage or gathering of the material during quilting that changes its dimensions. The shrinkage compensation is a solution to the problem caused by that fact that, in the process, the stitching sewn by the stitching mechanism tends to shorten the longitudinal dimension or length of the fabric due to the gathering of the material during quilting. The controller 29 predicts this shrinkage by repeated measurements. The amount of contraction or shrinkage varies as the quilted patterns are changed by the pattern control program of the controller 29. The shrinkage also varies as factors such as humidity in the plant vary, and due to other factors that cannot be readily predicted. The calculated shrinkage is used by the controller 29 to control the amount of feed of web 12 to the quilting station 11, to control the location of the quilted pattern in relation to the web 12, to control stitching mechanism 23 and drive assembly 49 to adjust the elongation or spacing of the quilted patterns so that they occupy the appropriate length or positions on the shrunken cut panels, and to control the feed of the quilted web 13 out of the quilting station 11. The control also uses the shrinkage calculation to either register the patterns on the web in relation to the locations of material splices on the web, or to signal where splices are to be made in the webs of fabric 15, 17 and 19 being fed to the quilter.

Figure 2:
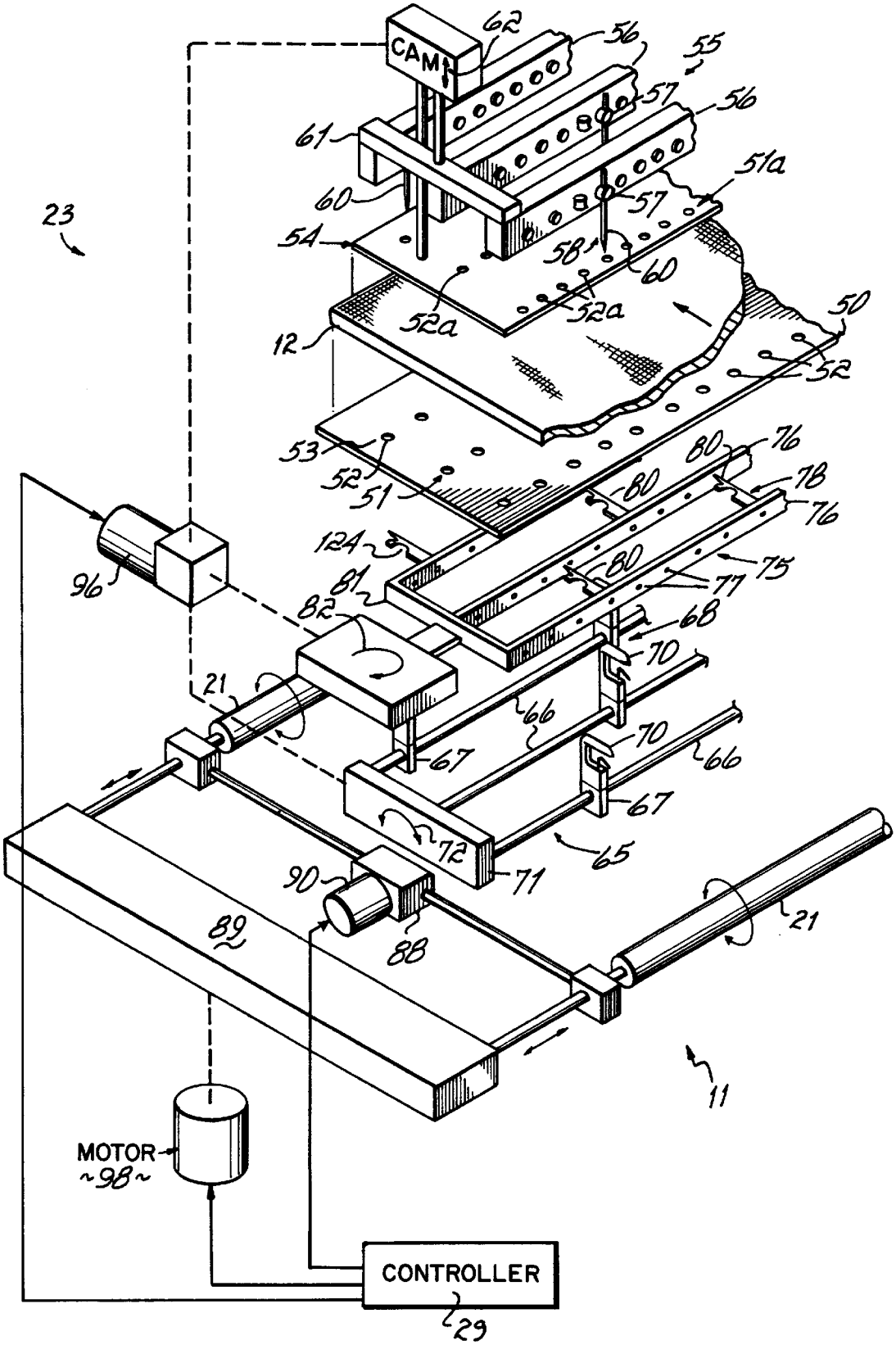
FIG. 2 is a partial exploded perspective view of the quilting station of the machine of FIG. 1.

The quilting portion of such a machine is illustrated in FIG. 2 and is described in greater detail in the commonly assigned U.S. Pat. No. 5,154,130 entitled Multi-Needle Double Lock Chain Stitch Tack, Jump and Thread Trimming Quilting Method and Apparatus, also expressly incorporated herein by reference. As illustrated in FIG. 2, the stitching mechanism 23 of the quilting station 11 includes a plurality of stitch forming elements positioned above and below a needle plate 50. The plate 50 supports the fabric web 12 as patterns, such as pattern are stitched on it to form the quilted web 13. The plate 50 has a matrix 51 of needle receiving holes 52 therein spaced approximately one inch apart in three parallel rows 53, spaced about six inches apart. A presser plate 54, which is located above the plate 50, moves down to press the fabric 12 against the plate 50 to hold the fabric as the needle is extended through it, and moves up to allow the fabric 12 to be moved. The presser plate 54 also has a matrix 51*a* of holes 52 *a* therein which correspond to the matrix 51 of needle holes 52 in the plate 50.

Positioned above the rows 53 of holes 52 of the plate 50 is a set 55 of three parallel transversely oriented and longitudinally spaced needle support bars 56, each having a matrix of needle holders 57 thereon corresponding to, and spaced directly above, each of the holes 52 in the matrix 51 in the needle plate 50. Each of the holders 57 includes a vertical groove in the front face of the bar 56 and a clamping screw positioned in a threaded hole beside the groove to clamp against a flat face of the shank of the needle positioned in the groove to hold the needle securely in position. Mounted in selected ones of the holders 57 is a needle array 58 of a plurality of needles 60, so positioned to define the relative spacings of patterns. The needle bars 56 are ganged through cross members 61, mounted to reciprocate vertically on a stationary frame (not shown) of the quilting station 11 to move up and down on the frame, as shown by the arrow 62, so that each of the needles 50 passes through a corresponding hole 52 in the needle plate 50.

Positioned beneath the rows 53 of holes 52 of the plate 50 is a set 65 of three parallel transversely oriented and longitudinally spaced looper support rods 66, each having a plurality of looper holders 67 thereon corresponding to, and spaced directly below, each of the holes 52 in the matrix 51 of holes 52 in the needle plate 50. Mounted in selected ones of the holders 67 is a looper array 68 of a plurality of loopers 70, so positioned to correspond one to each of the needles 60, in approximately vertical but exact alignment therewith. The looper bars 66 are pivotally mounted to the frame at quilting station 11 and linked through cross linkage 71 to oscillate in synchronism in a longitudinal vertical plane in which a corresponding one of the needles 60 and holes 52 lie, as shown by the arrow 72.

Positioned approximately 1/32" beneath the plate 50, adjacent the rows 53 of holes 52 of the plate 50, is a set 75 of three parallel transversely oriented and longitudinally spaced retainer support strips 76, each having a plurality of threaded retainer mounting holes 77 thereon corresponding to, and spaced below and adjacent, each of the holes 52 in the matrix 51 in the needle plate 50. Mounted with screws at selected ones of the holes 77 is a retainer array 78 of a plurality of retainers 80, so positioned to correspond one to each of the needles 60 and loopers 70. The retainer strips 76 are ganged together by linkage 81, in the form of rigid bars, to move in synchronism to carry each of the retainers 80 in small circles of approximately 3/8th inch in diameter, as shown by arrow 82, in a horizontal plane below the plate 50.

The needle bars 56, looper rods 66 and retainer strips 76, and the cross members and linkages 61, 71 and 81 that respectively join them, are linked together and driven by the common stitching mechanism 40. The mechanism 23 moves cyclically so as to move the stitch forming elements, which include the needles 60, the loopers 70 and the retainers 80, in one stitch forming cycle for each cycle of the mechanism 23, thereby forming one stitch of a pattern.

Figure 3B:
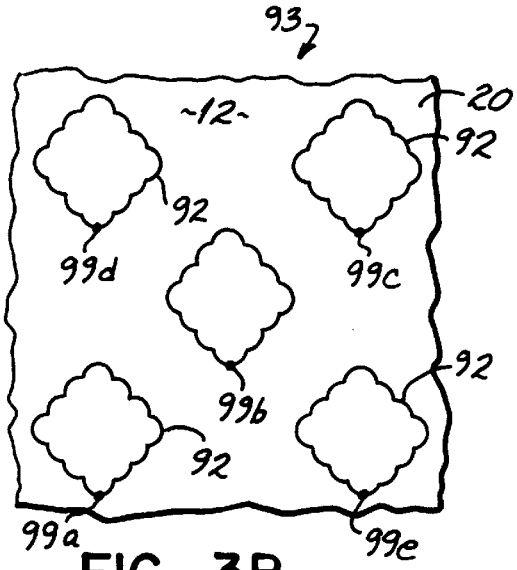
FIGS. 3A–3D are plan diagrams illustrating various types of patterns quilted on the apparatus of FIG. 1.
Figure 3A:
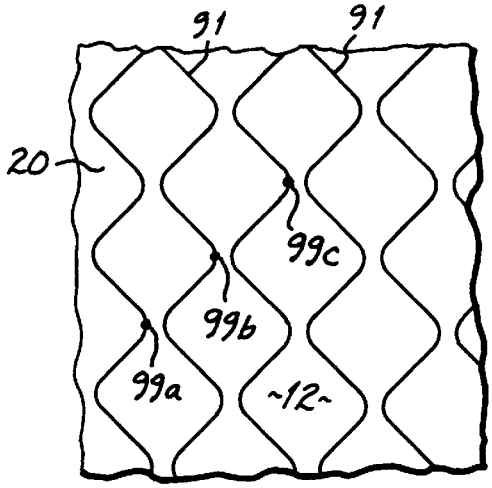

FIG. 3A illustrates an array of continuous patterns 41, typical of the prior art, that can be formed on the machine 10 of FIG. 1. This figure shows how a pattern 91 will be formed by one needle 52 on each of the needle bars 56, each needle 52 being spaced transversely to overlie points 99*a*, 99*b* and 99*c*. An array 93 of discrete patterns such as the patterns 92 is illustrated in FIG. 3B, in which the three needle positions 99*a*, 99*b* and 99*c*, plus two needle positions 99*d* and 99*e* are combine to form five patterns 92 of the array 93 in the segment of the quilt 13 illustrated. The closed 360° pattern 92 is achieved by programmed motion of the fabric 12 transversely and longitudinally by motion of the feed rollers 21 and 22 in synchronism with the operation of the stitch forming mechanism 23, to form stitches, preferably of equal length in the pattern shape. The 360° patterns 92 of the array 93 are accomplished by forward and reverse rotation of the feed rollers 21 and 22 as well as transverse reciprocating motion of the rollers 21 and 22. The discrete character of the patterns 92 involves the formation of several tack stitches upon the completion of each transverse row of simultaneously stitched patterns 92, a cutting of at least the top or needle threads, and a repositioning of the fabric 12 under the needles 60 for the beginning of the next pattern.

Figure 3C:
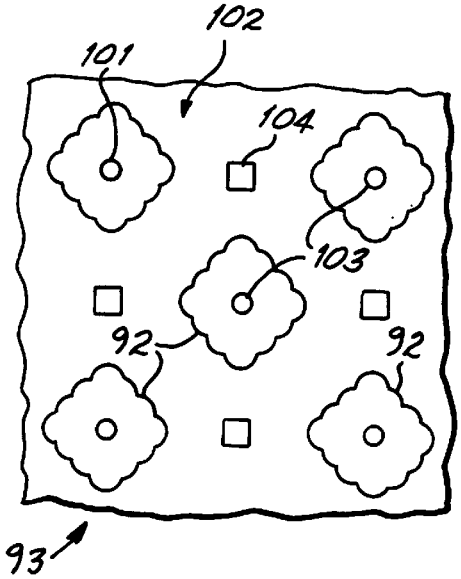
Figure 3D:
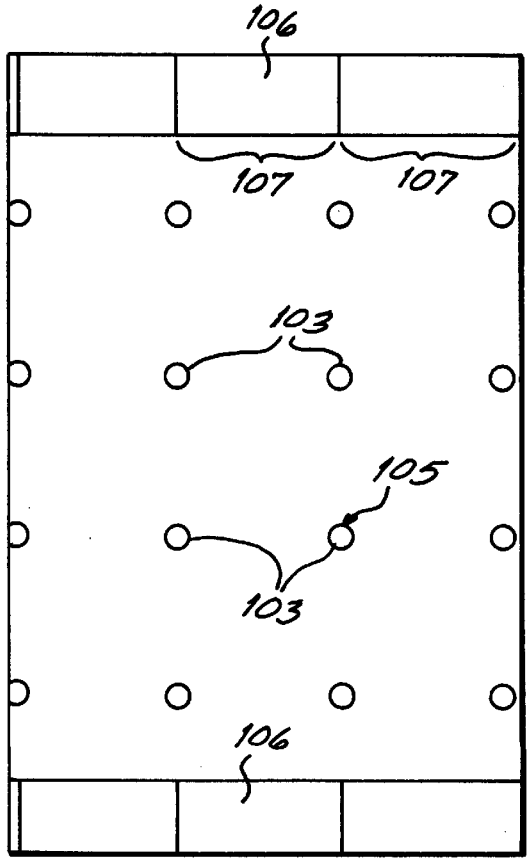

FIG. 3C illustrates a combination pattern 100 of the type formed by the method and apparatus of the preferred embodiment of the invention. The pattern 100 includes the pattern array 93 of patterns 92 and, in addition, pattern arrays 101 and 102 formed respectively formed of circular patterns 103 and square patterns 104. FIG. 3D illustrates another combination pattern 105 that includes a pattern array similar to the array 102 formed of the circular patterns 103 and also includes pattern arrays 106 made up of the patterns 107. The patterns of the arrays 101, 102, 105 and 106 may be each separately formed in the same manner as the discrete patterns 92.

To move the fabric 12 relative to the sewing mechanism 23 to cause patterns to be formed, both of the sets of feed rollers 21 and 22 are driven in synchronism by the a feed roller movement mechanism that includes a roller reversible rotary drive 88. The reversibility of the drive 88 and the ability to pull the fabric 12 from the front by rollers 21 as well as from the back by rollers 22, provides an ability to form 360° patterns such as pattern 92. The rollers 21 and 22 are also shiftable transversely, in synchronism with each other, by transverse roller drive 89. These roller drives 88 and 89 are electronically linked to the stitch forming mechanism 23 by a controller 29. The rotary feed drive 88 is driven by feed motor 90 while the transverse drive 89 is driven by shift motor 98, which collectively constitute the positioning drive which implements the pattern shape. The ratio and relative direction of the drives 88 and 89 and the mechanism 23 is controlled in response a pattern program within the controller 29 that is responsive to pattern data. The drives 88 and 89 and the motors 90 and 98 can be driven in synchronism with, or disengaged from, the mechanism 23, which is driven by a separate drive motor 96, which forms the stitching drive which affects the formation of stitches of the pattern. Each motor and the respective drives 88, 89 and the mechanism 23 can thus be locked in position while the others are activated, under control of the controller 29.

In prior art systems capable of making only the pattern arrays 91 and 93 of FIGS. 3A and 3B, the controller 29 is provided with two databases 110 and 111. Such a database 110 contains, for example, one record for each product of which is the machine 10 is programmed to produce. The database 110 also identifies a file in a $Pattern_{13}Shape_{13}$ File library 111 which contains the step by step positioning information to be sent by the controller 29 to the positioning drive. This database 110 includes fields such as the following listed in Table 1:

TABLE 1

| | |
|---|---|
| Product_ID | which identifies the product by product number |
| Product_Description | which provides description of the product |
| Pattern_Type | C=continuous pattern (FIG. 3A), T=single tacked discrete pattern (FIG. 3B), |
| Material_Type | informs operator web of material to be loaded onto machine, including material type and width |
| Material_Size | the cutoff length of the finished quilted panels |
| Pattern_Shape | identifies the Pattern_Shape_File to be used |
| Stitch_Size | the stitch length |
| Sewing_Speed | the cycle speed in stitches per second |
| Jump_Distance | for tacked discrete patterns (type T), specifies the distance that the material web is to be longitudinally advanced form the end tack of one |

TABLE 1-continued

| | |
|---|---|
| | pattern to the start of the next repeat of the pattern |

With the preferred embodiments of the invention, an additional or pattern data database 112 is preferably provided. The database 112 contains the pattern information data such as in the fields Pattern_Shape, Stitch_Size, Sewing_Speed, Jump_Distance, as well as a Product_ID field which identifies the product by product number, and the two additional fields listed in Table 2.

TABLE 2

| | |
|---|---|
| Pattern_Start | the distance that the material web is to be moved transversely from a reference position to the start of a pattern |
| Number_of_Repeats | the number of times a tacked discrete pattern (type T) pattern is to be repeated. |

For backward compatability, the database 110 may be used and contain the data necessary for the manufacture of the product as listed in Table 1. In the preferred embodiments, however, data in one of the fields, for example, in the Pattern_Type field, is used to alert the program in the controller 29 to look elsewhere for the pattern information data. This may include a Pattern_Type code of, for example R, designating that the pattern information is remotely stored. With such a structure, the data in fields of Product_Discription, Pattern_Type, Material_Type and Material_Size are nonetheless looked for by the program in the Product information database 110.

In certain preferred embodiments of the invention, a Pattern_Type of S is used to indicate that the pattern information is stored in the pattern information database 112. In particular, the Pattern_Type of S designates that the pattern may include one record of pattern data linked through the Product_ID field to the product master record in the product information database 110 or, more particularly, designates that the pattern may include more than one pattern or sub-pattern, each defined by a record in the pattern information database 112 and each linked through its Product_ID field to the product master record in the product information database 110. Alternatively, the records of the pattern information database 112 can be linked to the product master record of the product information database 110 through some other field, such as a field defined as Pattern_ID.

The S Pattern_Type, indicating, for example, a Sequential pattern series, calls for the formation of patterns by the quilting of one pattern or of more than one pattern sequentially to produce the combination patterns of, for example, FIGS. 3C and 3D. To accommodate the quilting of combination patterns using more than one sub-pattern quilted in sequence, the product master record has one of the fields, for example the field used for Jump_Distance for C and T type patterns, loaded with a variable for Pre_Jump_Distance, which designates a preliminary skip distance or border distance over which the web of material is to be advanced from the finishing of the previous product to a point that will serve as the origin for the next product. For S type patterns, the program in the controller 29 will respond to the data in this Jump_Distance field as the Pre_Jump_Distance and will cause the drives to position the material 12 accordingly.

To accommodate multiple sub-pattern combination patterns, the records of the pattern information database 112 are provided with additional fields with information used to specify the relationships between the different parts of the pattern and insure that the patterns are quilted and linked together properly. These fields include a field specifying the Step_Number. The number of records in the pattern information database 112 that is equal to the number of linked patterns will be contain the same Product_ID or Pattern_ID are read by the program of the controller 29 and the sub-patterns defined by the information therein are quilted in the sequence specified by the numbers in the Step_Number field.

Figure 4:
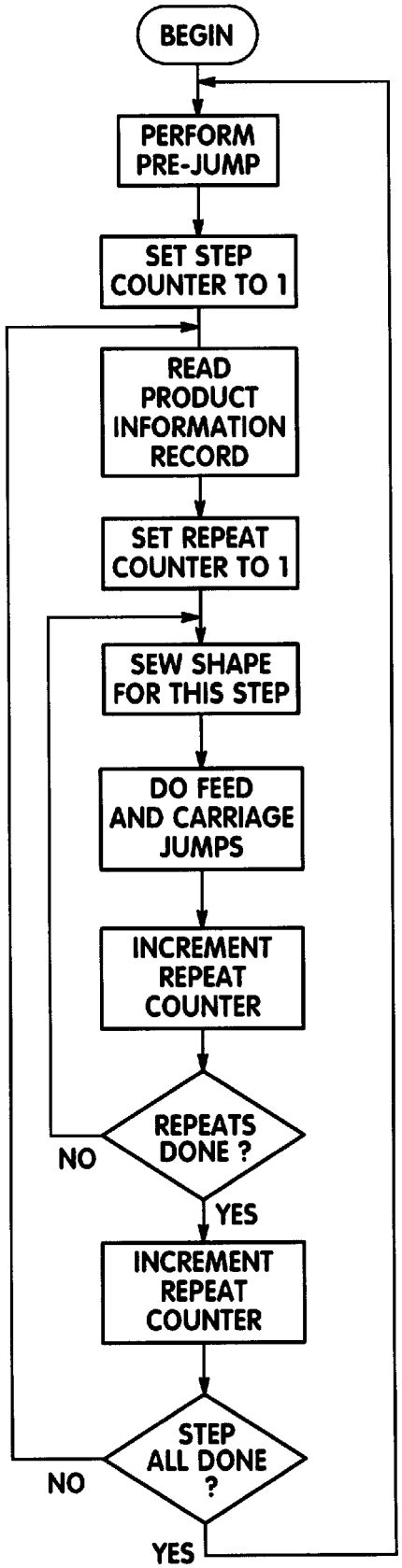
FIG. 4 is a flowchart representing the pattern linking routine executed by the controller of the machine of FIG. 1.

The quilting of the sequence of patterns linked to a Product_ID in the Pattern_Sequence database is implemented by a routine in the program of the controller 29 according to the flowchart of FIG. 4. The main program of the controller 29 reads customer order information and batch data then begins execution of a single quilt making operation sequence. This involves a reading of the product master record for the quilt from the product information database 110. From this database record for the product information such as Product_Description and Material are displayed to the operator. If the material and other machine settings are not the same as those previously set, the machine pauses so that the operator can make any material changes or other machine set-ups necessary to produce the described product.

When the operation continues, if the Pattern_Type specified in the product master record specifies a continuous pattern (type C) or standard TACK & JUMP™ pattern (type T), then a product is quilted using the pattern information data for a single patter. If, however, a sequential multiple pattern product is to be quilted (type S), then the controller 29 begins to execute the program module (200) illustrated in the flowchart of FIG. 4 by first (201) advancing the web 12 by the Pre_Jump_Distance specified in the Jump_Distance field of the product master record. This places the web 12 and quilting elements in proper relationship for the beginning of the first pattern.

Then the controller 29 (202) sets a step counter to 1 (203) reads each record from the pattern information database 112 that is linked to the product master record in the product database 110 through matching Product_ID fields in the order specified in the Step_Number field. These records contain the information of the individual sub-patterns specified in each of the pattern information records that define a single combination pattern that are to be quilted according to the parameters contained in the Pattern_Shape, Stitch_Size, Sewing_Speed, Jump_Distance, Pattern_Start and Number_of_Repeats fields of the records.

Then, the controller (204) sets a repeat counter to 1 and (205) quilts the first pattern shape on the web 12 by calling the pattern shape file specified in the record for step 1 in the pattern information database record that was read. This includes the relative positioning of the web 12 relative to the quilting elements in the correct transverse start position according to the Pattern_Start and in the pattern information database 112. Then, (206) the web 12 shifts longitudinally by the amount of the Jump_Distance to the next repeat of the pattern and (207) the repeat counter is incremented. If (208) the counter does not exceed the Number_of_Repeats, the controller 29 returns to step (205) and another repeat of the pattern is quilted.

If (208) the counter does exceed the Number_of_Repeats, the controller 29 (209) increments the step counter. If (210) the step counter does not exceed the number of records in the product information database 112 linked to the Product_ID of the product being quilted, the controller 29 returns to step (203). If the step counter exceeds the number of steps, or if there are no more sub-pattern records linked to the Product_ID, then the controller 29 returns to step (201) to process the next product.

In order to avoid excessive reverse motion of the web 12, patterns such as the sub-pattern 106 of FIG. 3D, for example, are implemented as two separate sub-patterns in the pattern information database. That is, in step 1, one repeat of pattern 106 is quilted, then in step 2, four repeats of pattern 105 is quilted, followed by another single repeat of pattern 106 in step 3.

Those skilled in the art will appreciate that the applications of the present invention herein are varied, and that the invention is described in preferred embodiments Accordingly, additions and modifications can be made without departing from the principles of the invention.

What is claimed is:

1. A quilting apparatus comprising:

a quilting station having a horizontal needle plate thereat, a plurality of needles arranged in a needle array mounted above the needle plate and a plurality of loopers arranged in a looper array mounted below the needle plate, one needle of the needle array corresponding to a looper of the looper array to form a stitching element pair;

a plurality of transversely mounted rollers positioned to guide a web of multiple layered fabric over the needle plate and through the quilting station;

a positioning drive connected to the arrays and rollers operable to move the web relative thereto in a horizontal plane;

a quilting element drive connected to the arrays and operable to simultaneously drive the stitching element pairs to each form on a web a chain-stitched pattern in accordance with relative movement between the web and the needle and looper arrays by the positioning drive;

a motion controller including:

a memory containing pattern data entries defining each of a plurality of quilt patterns and product data entries defining each of a plurality of quilt products, each quilt product data entry having associated therewith the pattern data entry of at least one of the quilt patterns, the product data entry of at least one of the quilted products being linked to pattern data entries of at least two quilt patterns of the plurality and including coordination data of the spatial relationship of the at least two quilt patterns as they are to be sewn on a quilted product, and a program module programmed to cause the controller to control the positioning drive and the quilting element drive to quilt an array of chain stitched patterns on the web, one with each stitching element pair, in accordance with the program data entry of a selected one of the quilt patterns and in response to selected product data entry of said at least one quilted product, to quilt an array of combination patterns on the web by sequentially quilting on the web, in the spatial relationship determined by the coordination data, at least two spatially coordinated arrays of different chain stitched patterns defined by the pattern data entries linked to said selected product data entry.

2. The quilting apparatus of claim 1 wherein:

the memory has stored therein:

a pattern data table containing the plurality of different pattern data entries, each pattern data entry being configured to cause the pattern program to differently operate the controller to cause the quilting of a pattern array defined by a selected product data entry; and a product data table containing the plurality of product data entries, each product data entry being linked to at least one pattern data entry, at least one product data entry being linked to at least two pattern data entries, and at least two of the product data entries being linked to the same one of the pattern data entries and to at least one other different pattern data entries so that said two product data entries define different combination patterns that include one common pattern.

3. The quilting apparatus of claim 2 wherein:

the pattern data table includes a plurality of records, each containing one of the program data entries;

the product parameter data table includes a plurality of records, each containing one of the product parameter data entries.

4. The quilting apparatus of claim 1 wherein:

at least two of the product data entries being linked to different combinations of at least two of the pattern data entries to cause the quilting of different combination patterns on the web when selected.

5. A method of quilting patterns comprising the steps of:

(a) providing a multi-needle quilting apparatus operative to simultaneously quilt an array of patterns onto a web of multilayered material at a quilting station in response to pattern parameter data communicated thereto;

(b) providing a memory having stored therein a plurality of pattern files each having pattern parameter data therein configured to define a pattern of a predetermined shape;

(c) providing pattern information identifying a selected plurality of the pattern files and defining the spatial relationship of the files of the selected plurality thereof;

(d) positioning a panel length of the web of material at the quilting station; and (e) with a programmed controller and in response to the pattern information provided, sequentially communicating to the quilting apparatus pattern parameter data from each of the pattern files of the selected plurality to cause the apparatus to quilt, in sequence, spatially coordinated arrays of each pattern of the selected plurality to form a combination pattern on the panel length of the web at the quilting station.

6. The method of claim 5 further comprising the steps of:

(f) advancing the quilted panel length of the web of material from the quilting station and positioning a new panel length of material at the quilting station; and (g) repeating step (e) to form the combination pattern on the new panel length of the web at the quilting station.

7. The method of claim 6 further comprising the steps of:

(h) providing new pattern information identifying a different selected plurality of the pattern files;

(i) repeating steps (f) and (g) to form a different combination pattern on the new panel length of the web at the quilting station.

8. A method of quilting patterns comprising the steps of:

generating a plurality of pattern files each having data therein configured to define a pattern of a different predetermined shape;

generating combination pattern data defining a plurality of combination patterns by associating a different selected plurality of the pattern files with each defined combination pattern;

positioning a panel of multi-layered material at a quilting station of a quilting apparatus;

with a programmed controller of the quilting apparatus, reading combination pattern data defining a selected one of the defined combination patterns;

quilting one of the combination patterns on the panel of material at the quilting station by sequentially quilting each pattern of different predetermined shape defined by each pattern file associated with the selected one of the combination patterns defined by the read combination pattern data; then with the programmed controller, reading different combination pattern data defining a different selected one of the defined combination patterns; and quilting the different one of the combination patterns on another panel of material at the quilting station by sequentially quilting each pattern of different predetermined shape defined by each pattern file associated with the selected different one of the combination patterns defined by the read different combination pattern data.

9. The method of claim 8 wherein:

the combination pattern data generating steps each includes the steps of defining a plurality of combination patterns by associating with each, different selected pluralities of the pattern files and by associating at least one pattern file with more than one combination pattern.

* * * * *

UNITED STATES PATENT AND TRADEMARK OFFICE

CERTIFICATE OF CORRECTION

PATENT NO. : 6,026,756
DATED : February 22, 2000
INVENTOR(S) : Frazer et al.

It is certified that error appears in the above-identified patent and that said Letters Patent is hereby corrected as shown below:

Claims,

Original claim 11 was added by November 2, 1999 Amendment and referenced by the Examiner as allowed in the Notice of Allowability. Original claim 11 has been omitted from the patent. Original claim 11 dependent on original claim 8 is now patent claim 10 dependent on patent claim 7. Patent claim 10 is duplicated below.

10. The method of claim 7 wherein:

the providing of the new pattern information identifying a different selected plurality of the pattern files includes selecting at least one pattern file selected for the previously quilted combination pattern.

Signed and Sealed this

Twenty-fifth Day of December, 2001

*Attest:*

*Attesting Officer*

JAMES E. ROGAN
*Director of the United States Patent and Trademark Office*